US007789540B2

(12) United States Patent
Gordin et al.

(10) Patent No.: US 7,789,540 B2
(45) Date of Patent: Sep. 7, 2010

(54) HIGHLY REFLECTIVE LIGHTING FIXTURE VISOR

(75) Inventors: Myron K. Gordin, Oskaloosa, IA (US); Timothy J. Boyle, Oskaloosa, IA (US)

(73) Assignee: Musco Corporation, Oskaloosa, IA (US)

( * ) Notice: Subject to any disclaimer, the term of this patent is extended or adjusted under 35 U.S.C. 154(b) by 79 days.

(21) Appl. No.: 11/334,007

(22) Filed: Jan. 18, 2006

(65) Prior Publication Data

US 2006/0181875 A1 Aug. 17, 2006

Related U.S. Application Data

(60) Provisional application No. 60/644,636, filed on Jan. 18, 2005, provisional application No. 60/644,639, filed on Jan. 18, 2005, provisional application No. 60/644,536, filed on Jan. 18, 2005, provisional application No. 60/644,747, filed on Jan. 18, 2005, provisional application No. 60/644,534, filed on Jan. 18, 2005, provisional application No. 60/644,720, filed on Jan. 18, 2005, provisional application No. 60/644,688, filed on Jan. 18, 2005, provisional application No. 60/644,517, filed on Jan. 18, 2005, provisional application No. 60/644,609, filed on Jan. 18, 2005, provisional application No. 60/644,516, filed on Jan. 18, 2005, provisional application No. 60/644,546, filed on Jan. 18, 2005, provisional application No. 60/644,547, filed on Jan. 18, 2005, provisional application No. 60/644,638, filed on Jan. 18, 2005, provisional application No. 60/644,537, filed on Jan. 18, 2005, provisional application No. 60/644,637, filed on Jan. 18, 2005, provisional application No. 60/644,719, filed on Jan. 18, 2005, provisional application No. 60/644,784, filed on Jan. 18, 2005, provisional application No. 60/644,687, filed on Jan. 18, 2005.

(51) Int. Cl.
*F21V 7/00* (2006.01)

(52) U.S. Cl. ..... 362/359; 362/296.02; 362/346

(58) Field of Classification Search ..... 362/359, 362/346, 296, 297, 296.01, 296.02, 296.04
See application file for complete search history.

(56) References Cited

U.S. PATENT DOCUMENTS

| | | | | |
|---|---|---|---|---|
| 1,325,619 | A * | 12/1919 | Clemmans | 362/510 |
| 2,447,923 | A | 8/1948 | Tuck | |
| 4,816,974 | A | 3/1989 | Gordin | |
| 4,947,303 | A | 8/1990 | Gordin et al. | |
| 5,161,883 | A | 11/1992 | Gordin et al. | |
| 5,211,473 | A * | 5/1993 | Gordin et al. | 362/297 |
| 5,313,379 | A | 5/1994 | Lemons et al. | |
| 5,600,537 | A | 2/1997 | Gordin et al. | |

(Continued)

FOREIGN PATENT DOCUMENTS

| | | |
|---|---|---|
| EP | 1 172 839 A2 | 1/2002 |

(Continued)

*Primary Examiner*—Stephen F. Husar
*Assistant Examiner*—Peggy A. Neils
(74) *Attorney, Agent, or Firm*—McKee, Voorhees & Sease, P.L.C.

(57) ABSTRACT

An apparatus, method, and system for high intensity lighting with target area. One aspect includes extending a structure externally of a light fixture and utilizing a very high total reflectance reflecting surface on the structure to redirect incident light toward the target area in a highly efficient manner.

12 Claims, 24 Drawing Sheets

U.S. PATENT DOCUMENTS

Figure 1A:
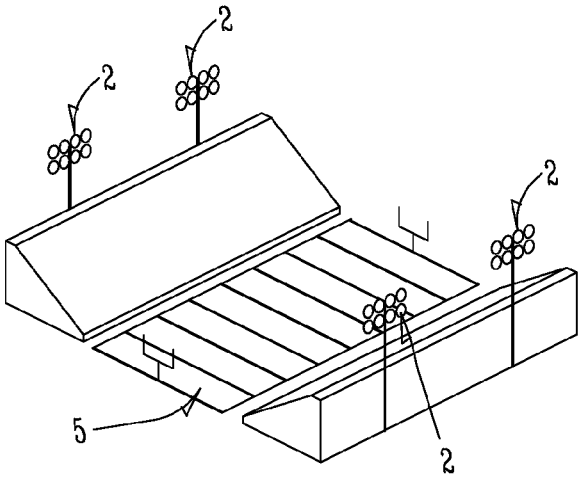
Figure 1B:
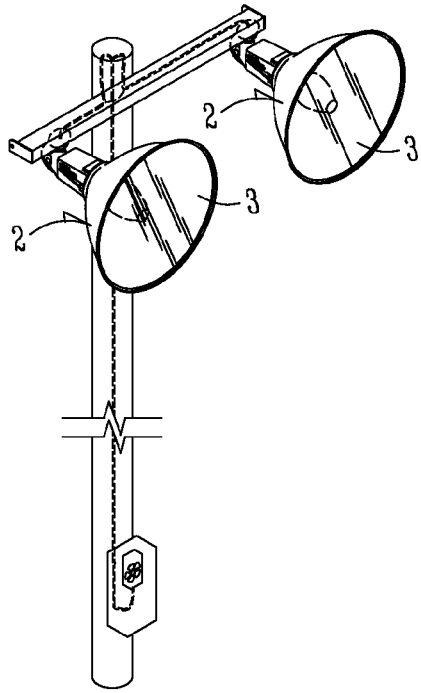

| | | | | |
|---|---|---|---|---|
| 5,651,606 | A * | 7/1997 | Krogman | 362/96 |
| 5,707,142 | A * | 1/1998 | Gordin | 362/346 |
| 5,730,521 | A | 3/1998 | Spink et al. | |
| 5,816,691 | A | 10/1998 | Gordin et al. | |
| 5,856,721 | A | 1/1999 | Gordin et al. | |
| 5,938,317 | A * | 8/1999 | Thornton | 362/290 |
| 6,036,338 | A | 3/2000 | Gordin | |
| 6,203,176 | B1 | 3/2001 | Gordin | |
| 6,497,501 | B1 * | 12/2002 | Harder | 362/359 |
| 6,502,965 | B1 | 1/2003 | Bradford | |
| 6,705,742 | B1 * | 3/2004 | Patterson et al. | 362/224 |
| 7,540,629 | B2 * | 6/2009 | Steinberg | 362/234 |
| 2003/0053314 | A1 * | 3/2003 | Summerford et al. | 362/342 |
| 2004/0037068 | A1 * | 2/2004 | Patterson et al. | 362/147 |

FOREIGN PATENT DOCUMENTS

| | | | |
|---|---|---|---|
| WO | 0063612 | A | 10/2000 |

* cited by examiner

SECTION B-B

SECTION D-D

SECTION C-C

SECTION A-A

Flat View

Formed View

FLAT PATTERN

FORMED VIEW

FLATT PATTERN

FORMED VIEW

FLATT PATTERN

FORMED VIEW

DETAIL B

DETAIL A

HIGHLY REFLECTIVE LIGHTING FIXTURE VISOR

CROSS REFERENCE TO RELATED APPLICATIONS

This application claims priority under 35 U.S.C. §119 of a provisional application U.S. Ser. No. 60/644,636 filed Jan. 18, 2005, herein incorporated by reference in its entirety. This application is also a non-provisional of the following provisional U.S. applications, all filed Jan. 18, 2005: U.S. Ser. Nos. 60/644,639; 60/644,536; 60/644,747; 60/644,534; 60/644,720; 60/644,688; 60/644,517; 60/644,609; 60/644,516; 60/644,546; 60/644,547; 60/644,638; 60/644,537; 60/644,637; 60/644,719; 60/644,784; 60/644,687, each of which is herein incorporated by reference in its entirety.

INCORPORATION BY REFERENCE

The contents of the following U.S. patents are incorporated by reference by their entirety: U.S. Pat. Nos. 4,816,974; 4,947,303; 5,161,883; 5,600,537; 5,816,691; 5,856,721; 6,036,338.

I. BACKGROUND OF THE INVENTION

A. Field of the Invention

The present invention relates to lighting fixtures that produce high intensity, controlled, and concentrated light beams for use at relatively distant targets. In particular, the invention relates to such lighting fixtures, their methods of use, and their use in systems where a plurality of such fixtures are used in combination, usually elevated on poles, to compositely illuminate a target area energy-efficiently, with reduced glare and spill light, and with the capability to lower capital and/or operating costs. One primary example is illumination of a sports field.

B. Problems in the Art

This general configuration of sports lighting fixtures 2 (see FIGS. 1A-G) has remained relatively constant over many years because it is a relatively economical and durable design. It represents a reasonable compromise between the desire to economically control high intensity light to a distant target while at the same time minimizing wind load, which is a particularly significant issue when fixtures are elevated out-of-doors to sometimes well over 100 feet in the air. A much larger reflector could control light better. However, the wind load would be impractical. A significant amount of the cost of sports lighting systems involves how the lights are elevated. The more wind load, the more robust and thus more expensive, the poles must be.

In recent times, sports lighting has also had to deal with the issue of glare and spill light. Therefore, competing interests and issues provide challenges to sports lighting designers. Some of the interests and issues can be at odds with one another. For example, the need always remains for more economical sports lighting. On the other hand, glare and spill control can actually add cost and/or reduce the amount of light available to light the field. Designers have to balance a number of factors, for example, cost, durability, size, weight, wind load, longevity, and maintenance issues, to name a few. Attempts to advance the art have mainly focused on discrete aspects of sports lighting. For example, computerized design of lighting systems tends to minimize hardware costs and system installation costs but uses conventional lamp and fixture technology, with their weaknesses. Also, larger lumen output lamps produce more light, but are used with conventional fixture technology. A need, therefore, still exists for advancement in the art of sports lighting.

Current wide or large area lighting systems suffer from such things as energy lost in conversion of electricity to light energy; energy lost in the lighting fixture; and energy lost in light going to unintended or non-useful locations. The present invention addresses these issues.

II. SUMMARY OF THE INVENTION

The present invention also provides the ability to select different configurations to meet different needs for a lighting application. For example, features of the lighting system can be selected to achieve lower capital costs for the lighting system. Features can be selected to lower operating costs. Features can be selected to reduce glare and spill light. Features can be selected to increase the quantity or quality of light at and above the target space and/or the performance of the system. The invention allows concentration on just one of the above-listed features or on combinations of them.

In one aspect of the invention, a lighting fixture includes a visor with a very high total reflectance reflecting surface.

In another aspect, the visor comprises an exterior and shape to promote improved effective projected area and aerodynamics.

A. Objects, Features, or Advantages, of the Invention

It is therefore a principal object, feature, or advantage of the present invention to present a high intensity lighting fixture, its method of use, and its incorporation into a lighting system, which improves over or solves certain problems and deficiencies in the art.

Other objects, features, or advantages of the present invention include such a fixture, method, or system which can accomplish one or more of the following:

a) reduce energy use;

b) increase the amount of useable light at each fixture for a fixed amount of energy;

c) more effectively utilize the light produced at each fixture relative to a target area;

d) is robust and durable for most sports lighting or other typical applications for high intensity light fixtures of this type, whether outside or indoors;

e) can reduce glare and spill light relative a target space or area;

f) can reduce wind drag or effective projected area (EPA) of individual fixtures or sets of fixtures, which can allow smaller and/or less expensive elevating structures (e.g. poles), which in turn can materially decrease the capital cost of a lighting system.

B. Exemplary Aspects of the Invention

In an aspect of the invention, an additional reflecting surface extends forwardly from the general surface of revolution of the main reflecting surface and is made of high reflectivity material. As opposed to conventional visors which are used primarily to block light, this reflecting surface can function not only to block light that could be glare or spill light, but efficiently and in a highly controllable manner redirect the otherwise wasted light to the target area. The framework supporting the additional reflecting surface can be connected to the framework for the main reflecting surface in an integrated manner that also minimizes wind drag for the entire fixture.

These and other objects, features, advantages and aspects of the present invention will become more apparent with reference to the accompanying specification and claims.

III. BRIEF DESCRIPTION OF THE DRAWINGS

FIGS. 1A-G show a typical sports lighting system.

Figure 2A:
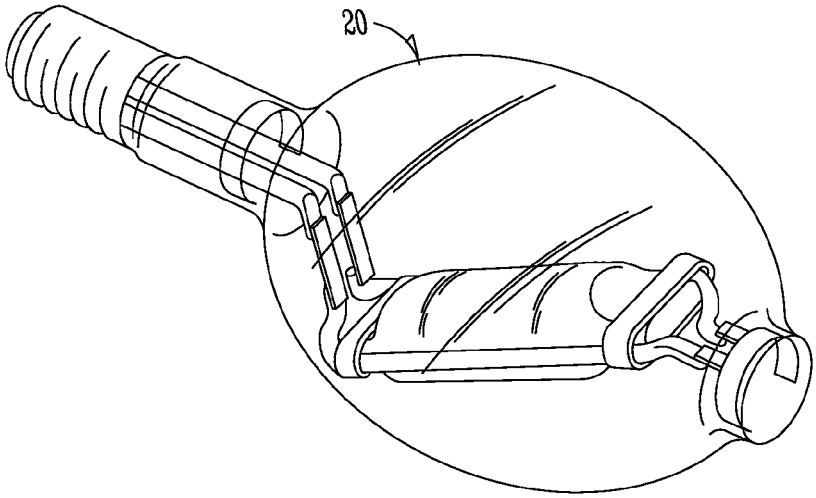
Figure 2B:
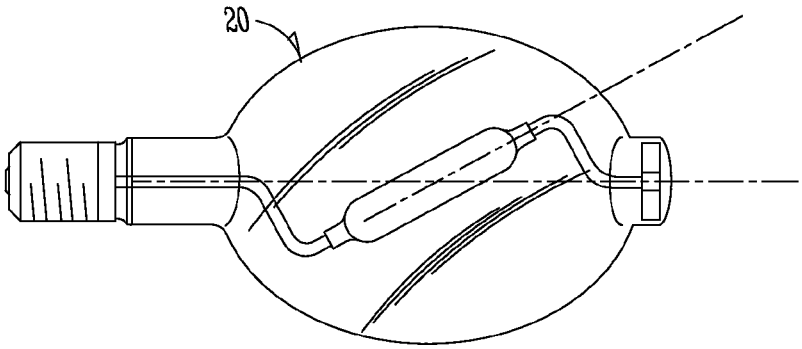

FIGS. 2A and B are views of an arc lamp that could be used with the invention.

Figure 3:
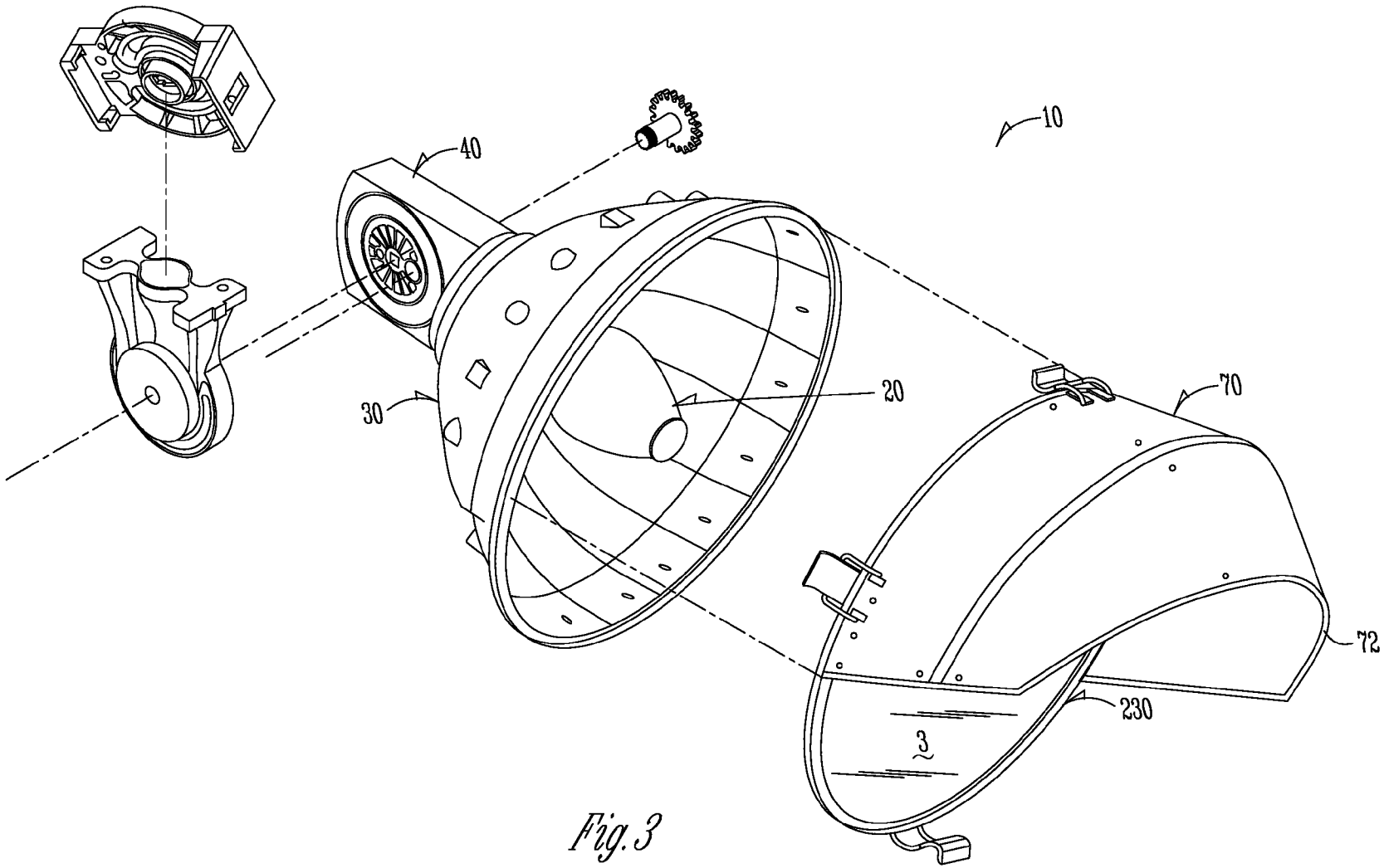

FIG. 3 is an exploded view of an embodiment of the invention.

Figure 4A:
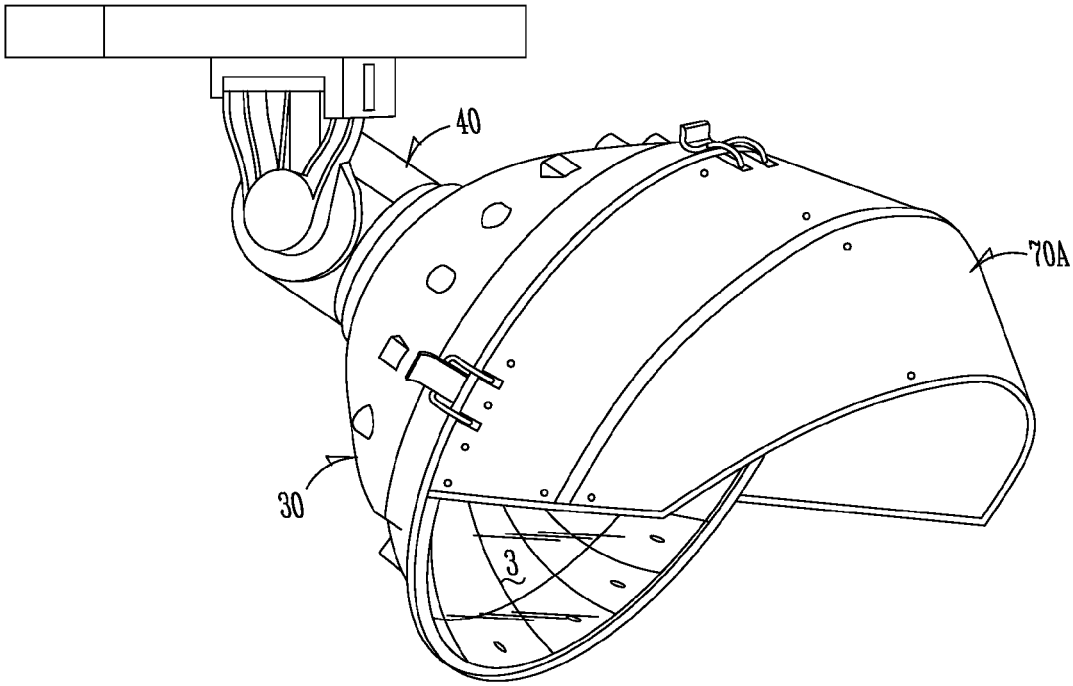
Figure 4B:
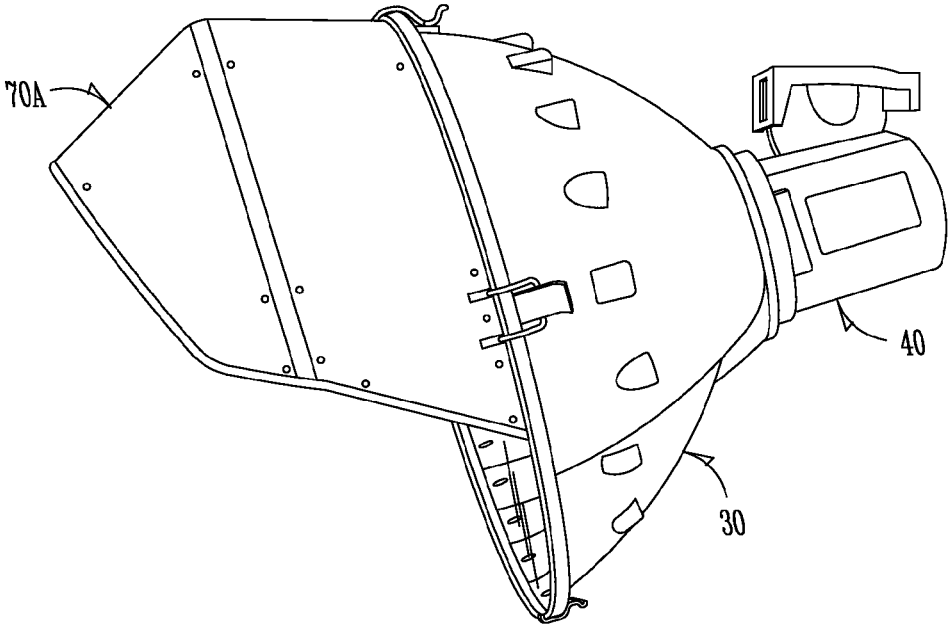

FIGS. 4A and B are various views of the fixture of FIG. 3 with a first exemplary embodiment of a visor (sometimes referred to as the short visor) according to the present invention.

Figure 5A:
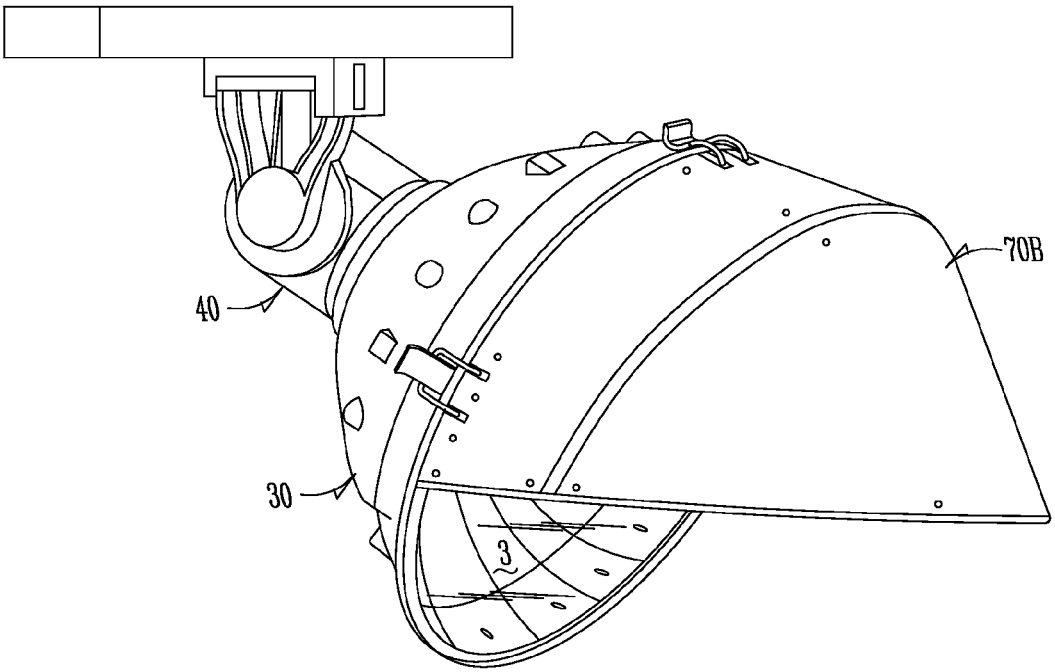
Figure 5B:
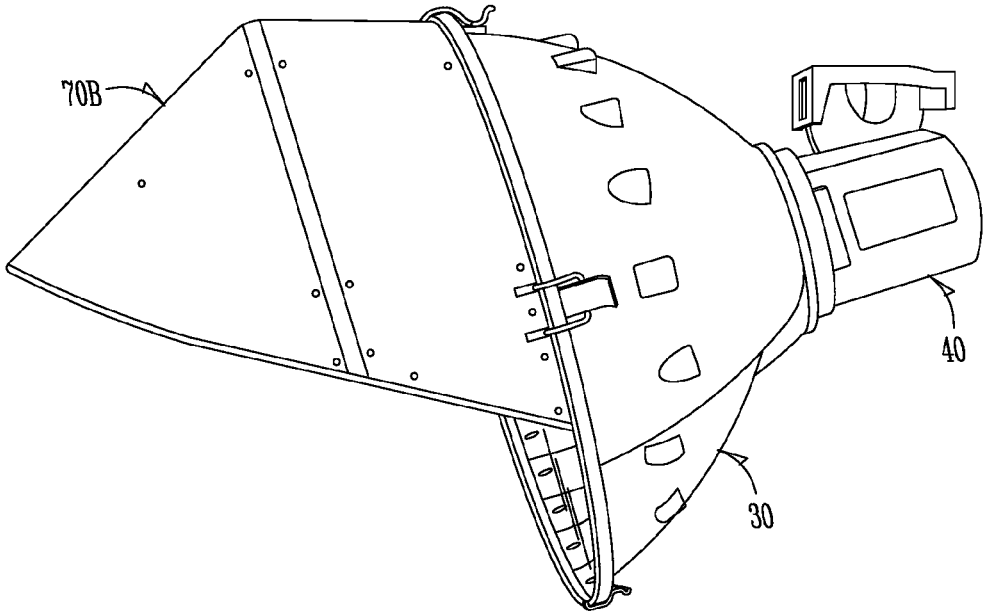

FIGS. 5A and B are similar to FIGS. 4A and B but with a second exemplary embodiment of a visor (sometimes referred to as the long visor) according to the present invention.

Figure 6:
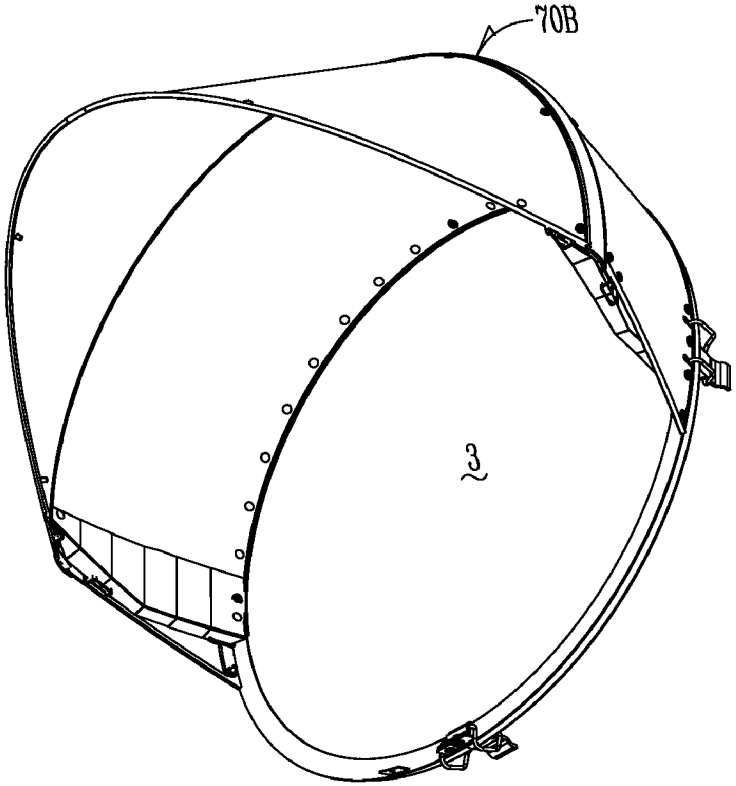
Figure 6:
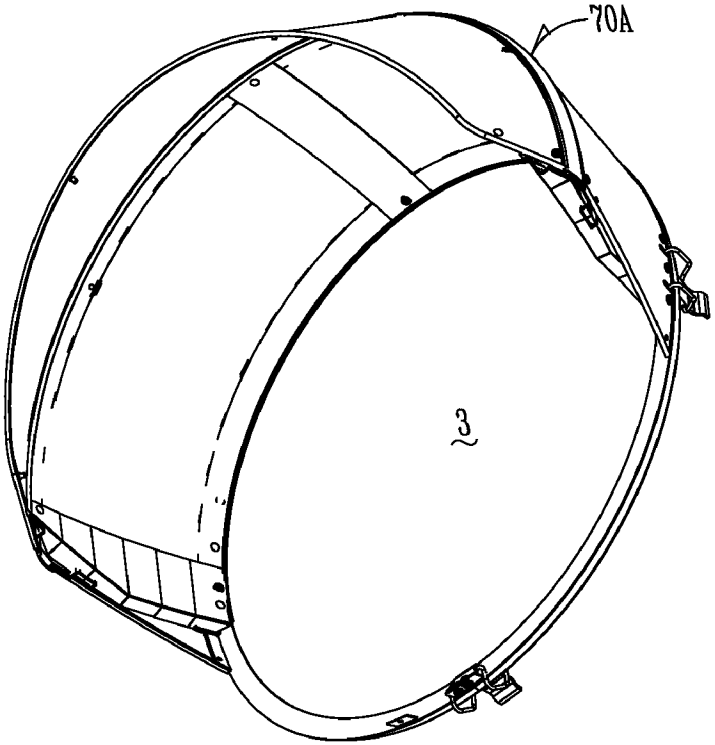
Figure 7A:
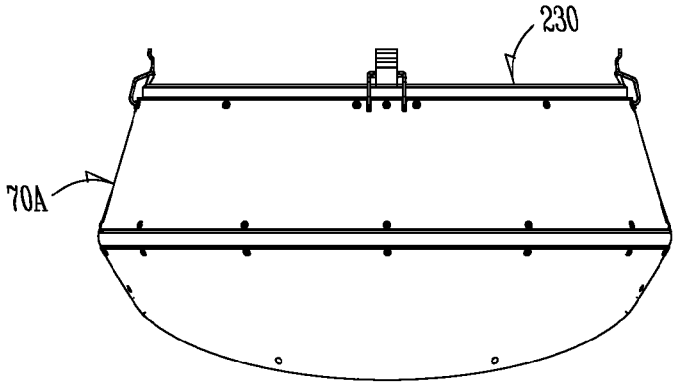
Figure 7B:
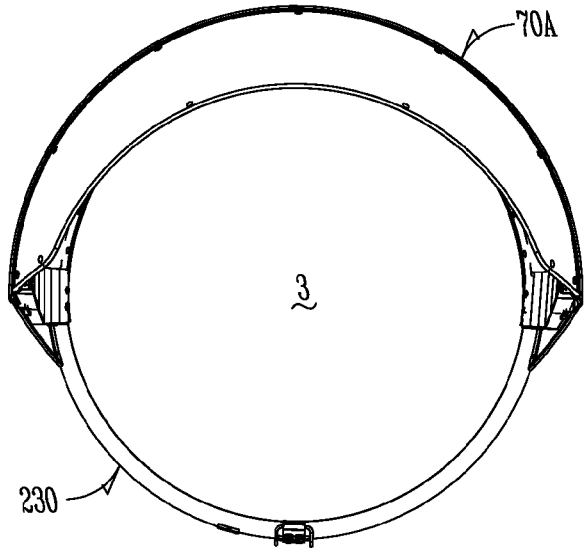
Figure 7C:
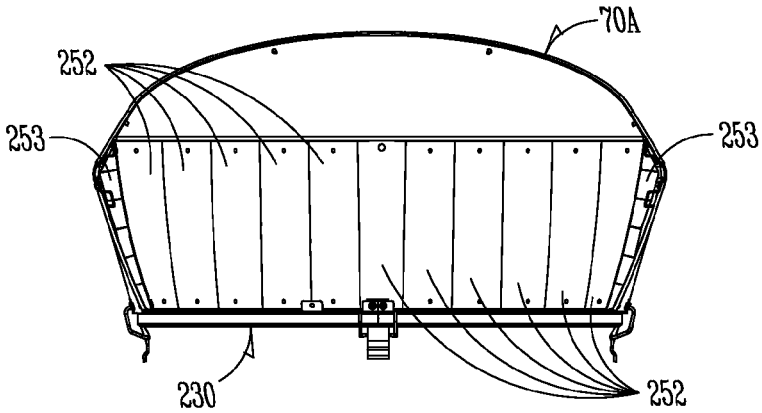
Figure 7D:
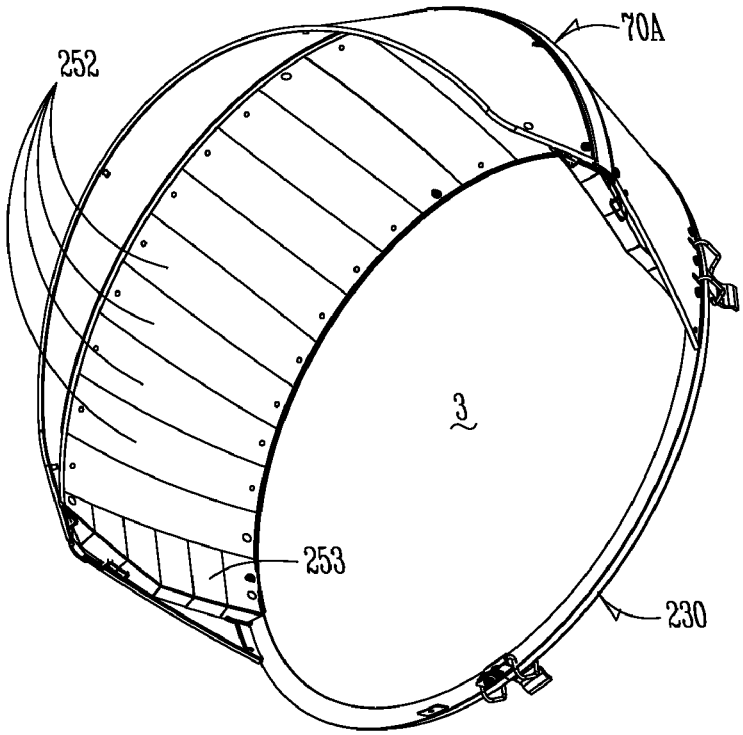

FIG. 6 is a side-by-side perspective view of the two visors of FIGS. 4A and B and 5A and B attached to a lens rim that can be mounted to a reflector frame and also showing examples of high reflectivity reflecting strips mounted on the underside of the visors.

FIGS. 7A-D are various views showing the left-most visor of FIG. 6.

Figure 8A:
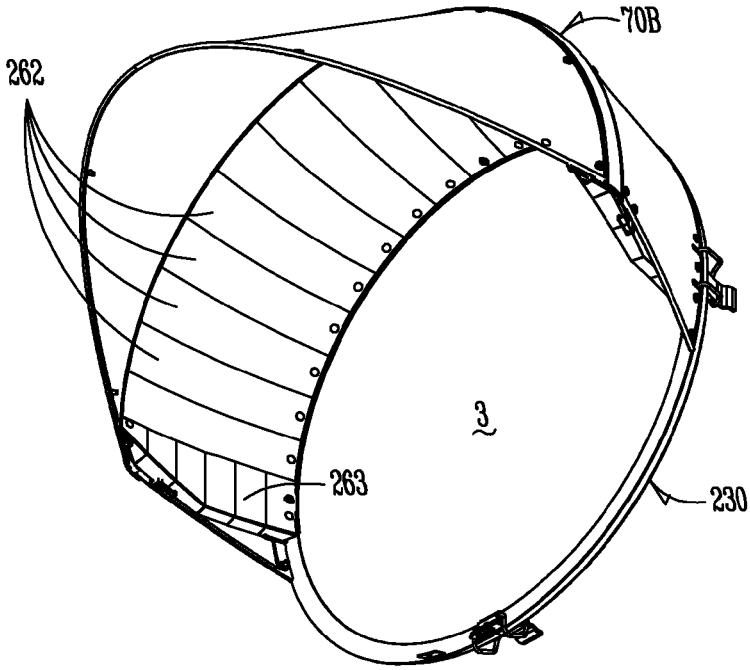
Figure 8B:
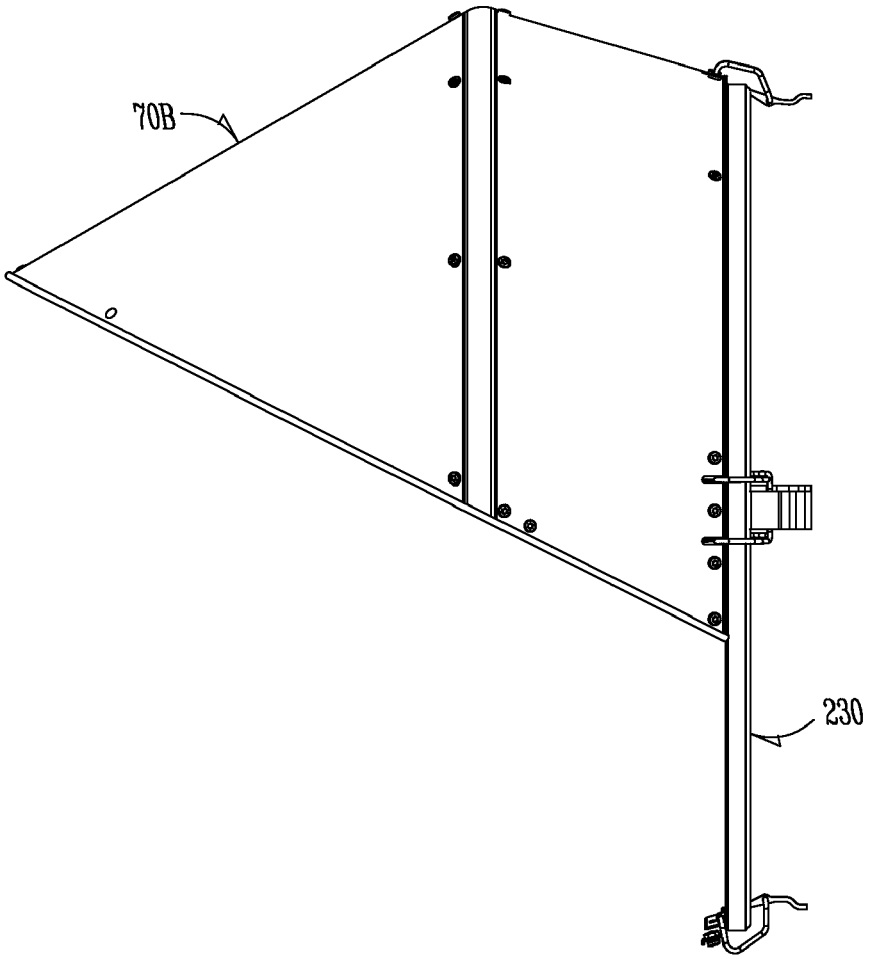
Figure 9A:
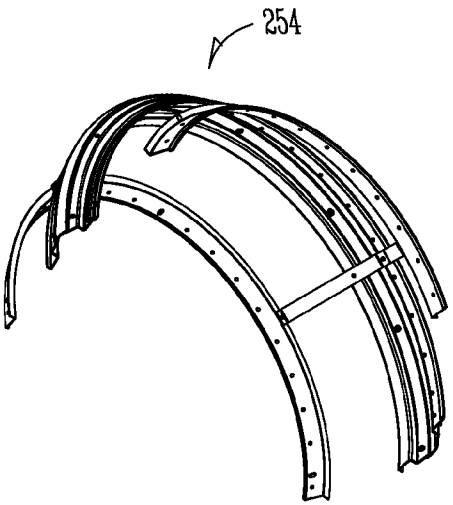
Figure 9E:
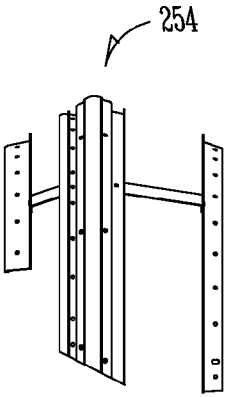
Figure 9C:
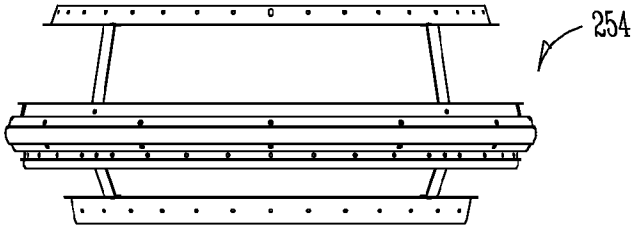
Figure 9B:
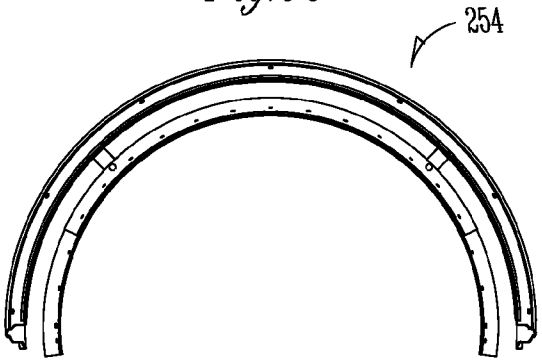
Figure 9D:
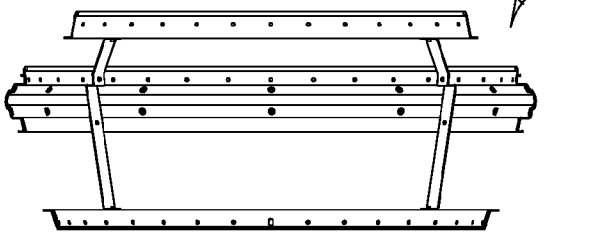
Figure 10A:
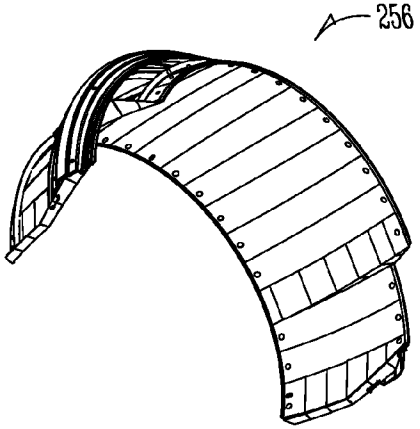
Figure 10E:
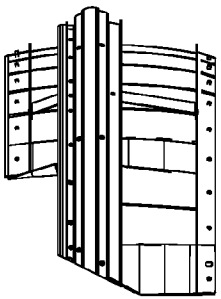
Figure 10C:
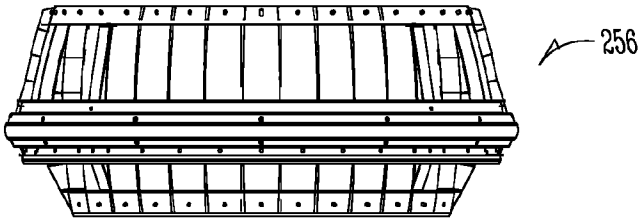
Figure 10B:
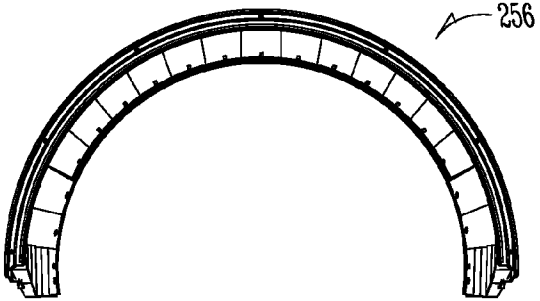
Figure 10D:
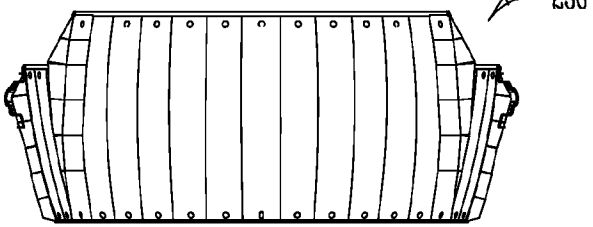
Figure 11A:
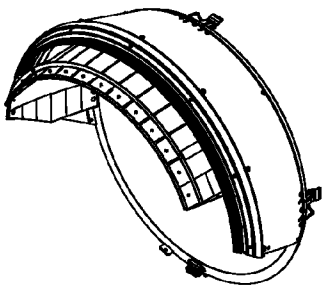
Figure 11E:
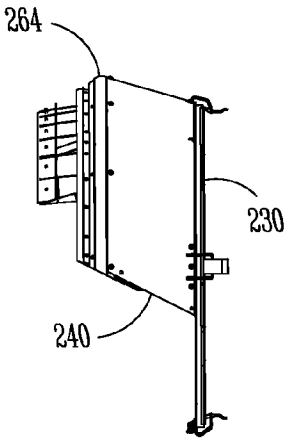
Figure 11C:
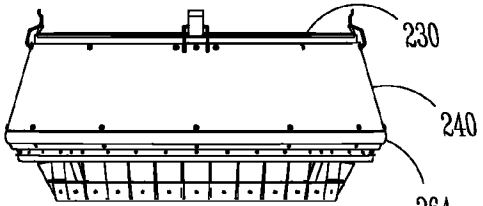
Figure 11B:
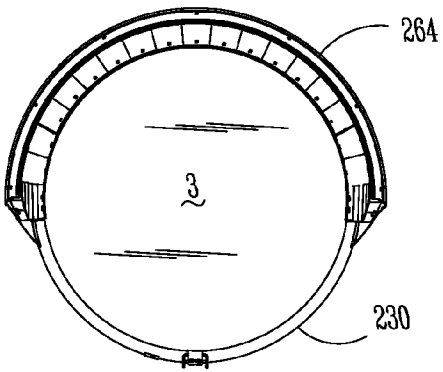
Figure 11D:
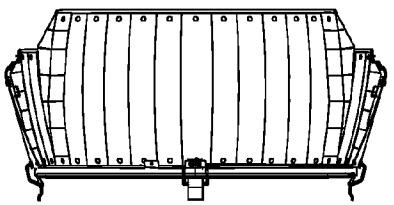
Figure 12F:
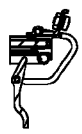
Figure 12H:
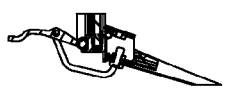
Figure 12G:
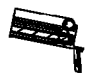
Figure 12A:
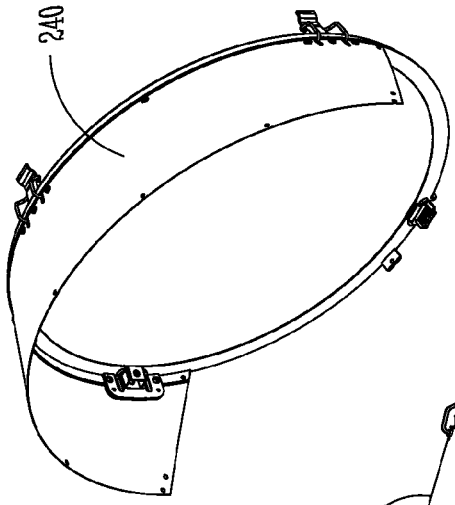
Figure 12E:
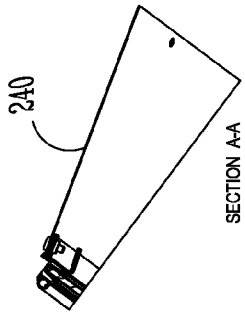
Figure 12D:
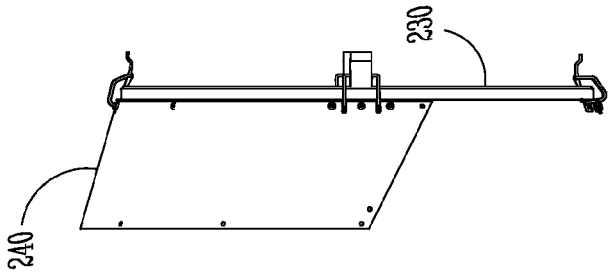
Figure 12C:
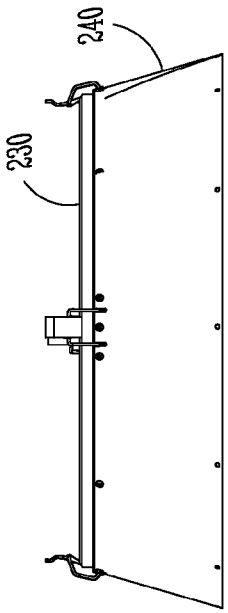
Figure 12B:
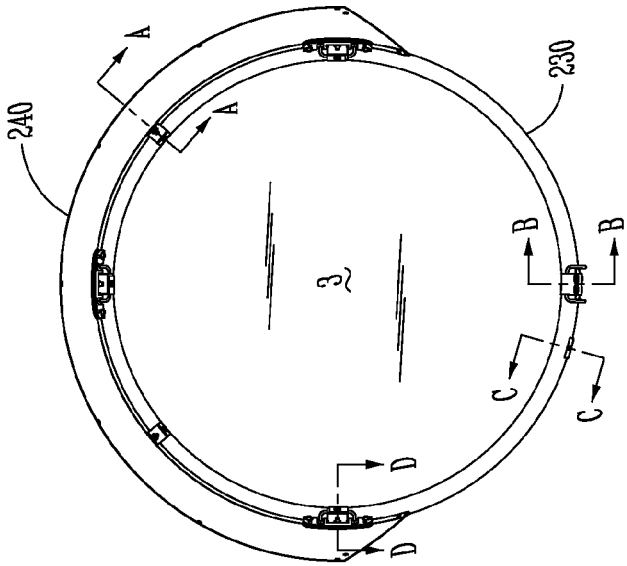

FIGS. 8A and B are various views of the right-most reflector of FIG. 6A.

FIGS. 9A-10E are views of a visor reflective insert upper rail and lower rail mountable on the inside of a visor to which can be attached high reflectance reflective insert strips. FIGS. 9A-E show the rails and FIGS. 10A-E show the rails of FIGS. 9A-E with reflective inserts overlaid.

FIGS. 11A-E show a visor transition clip securable to the inside of a visor for a transition between different sets of reflective inserts at different levels.

FIGS. 12A-H are various views of a base visor attachable to the lens rim of FIGS. 21A-E.

Figure 13:
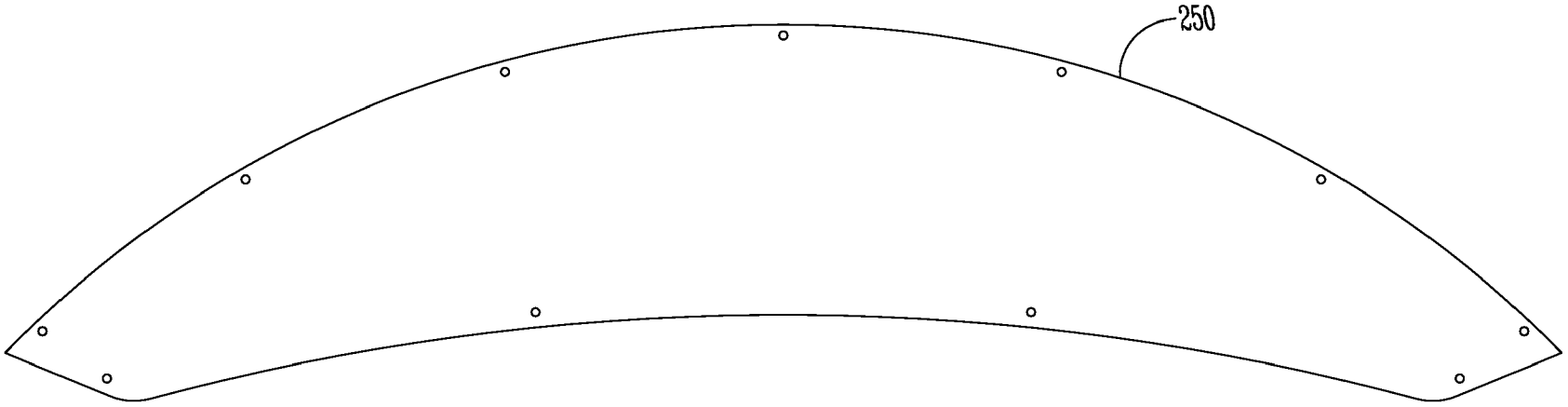

FIG. 13 is a plan view of a visor extension attachable to the base visor of FIGS. 12A-H to form the short visor of FIGS. 7A-D.

Figure 14C:
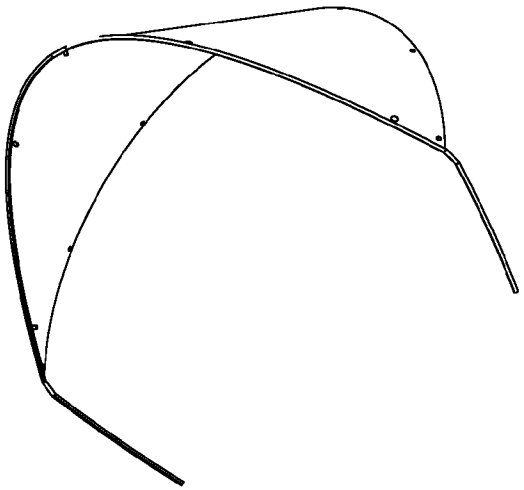
Figure 14B:
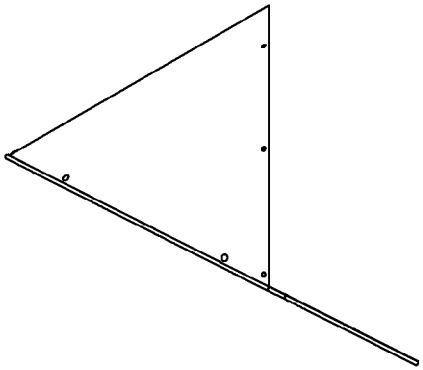
Figure 14A:
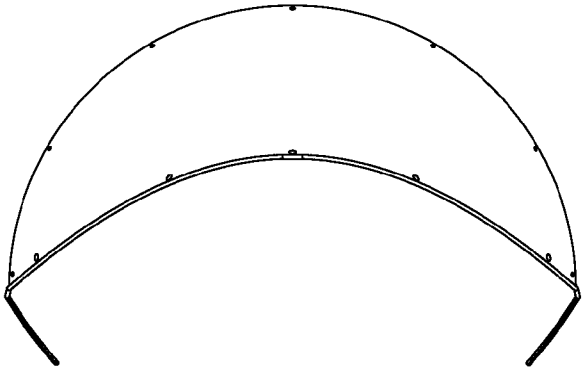

FIGS. 14A-C are various views of an alternative visor extension connectable to the base visor of FIGS. 12A-H to form the long visor of FIGS. 8A and B.

Figure 15A:
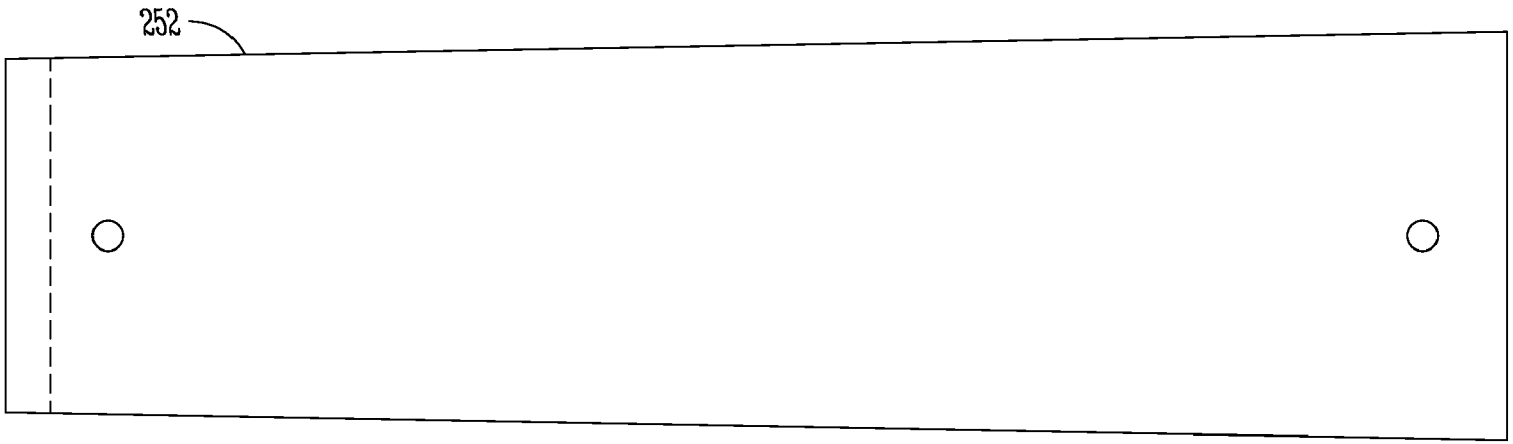
Figure 15B:
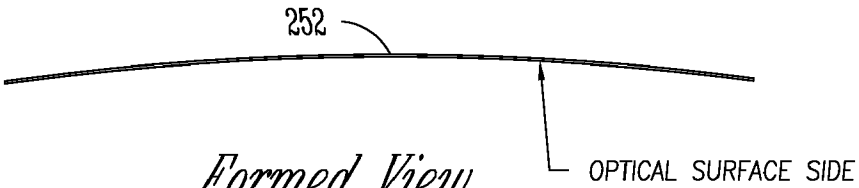

FIGS. 15A and -B illustrate one example of longer visor inserts.

Figure 16A:
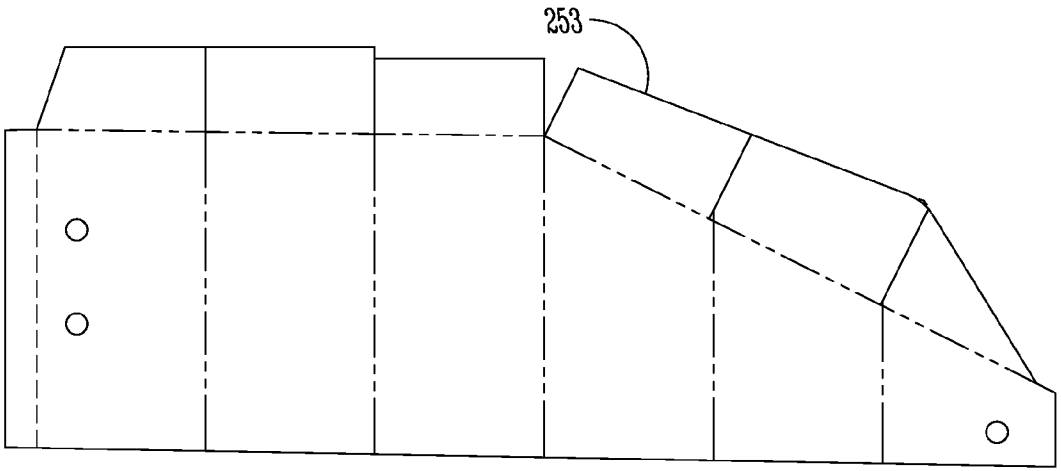
Figure 16B:
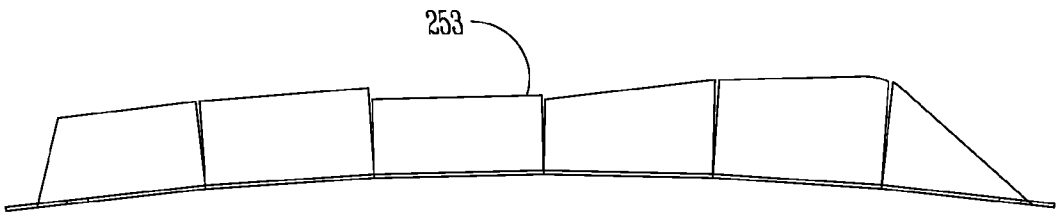
Figure 16C:
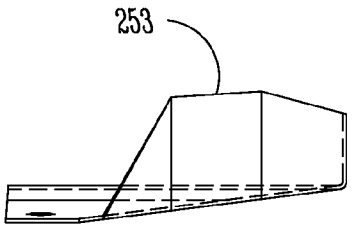

FIGS. 16A-C are various views of a specially configured end reflective visor insert positionable at opposite lateral sides of a visor.

Figure 17A:
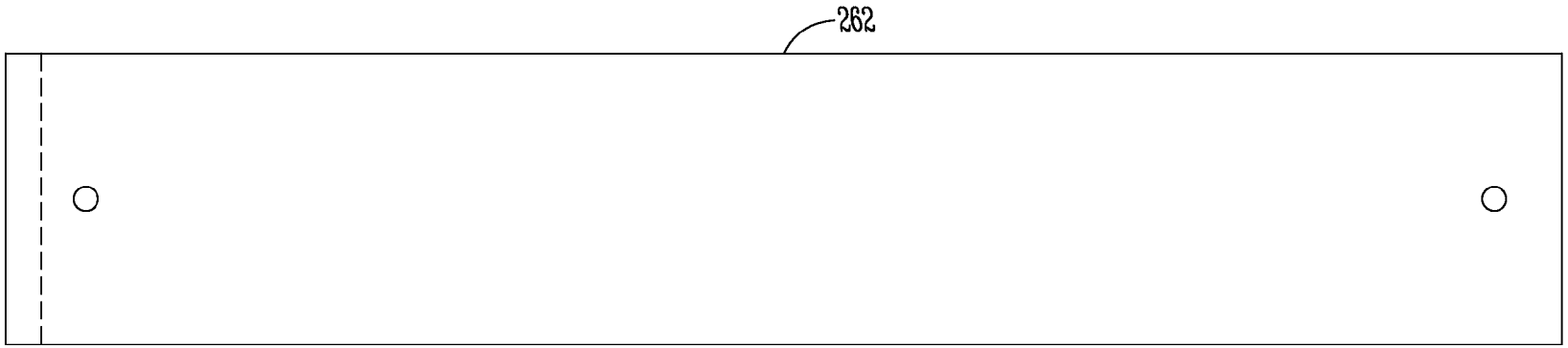
Figure 17B:
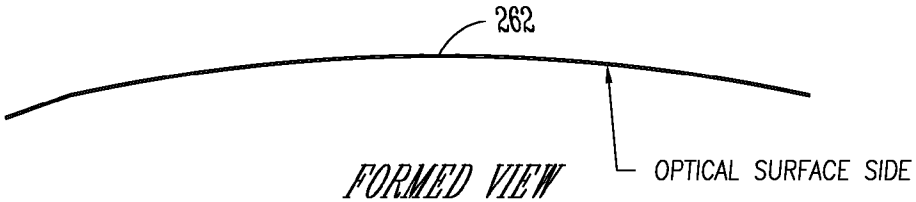

FIGS. 17A and -B are an alternative embodiment of the reflective visor insert in FIGS. 15A and B.

Figure 18A:
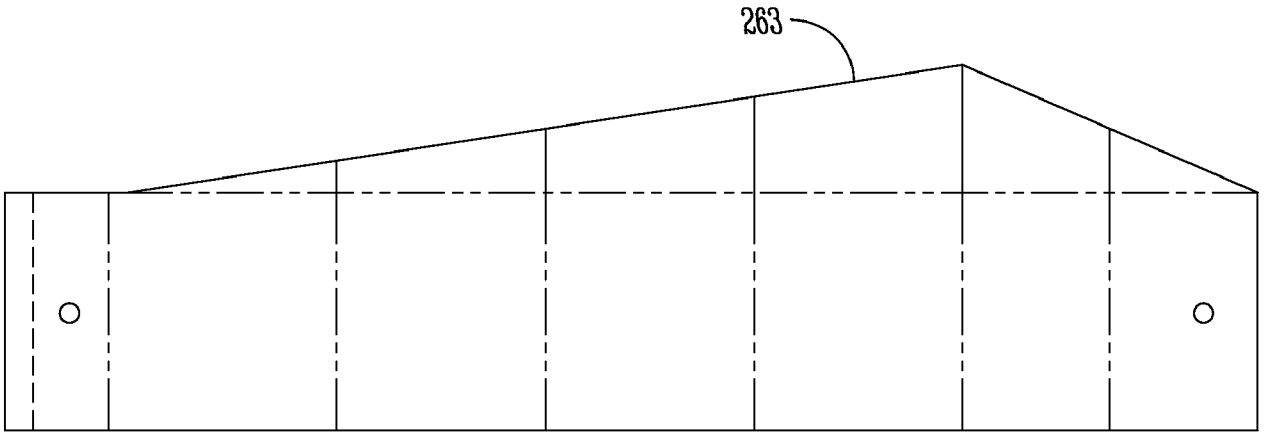
Figure 18B:
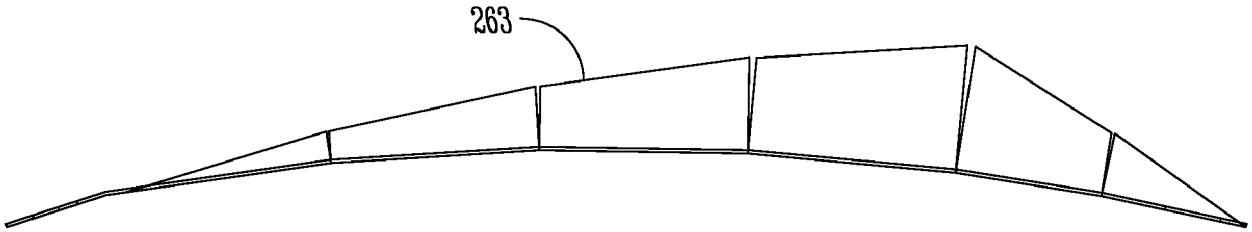
Figure 18C:
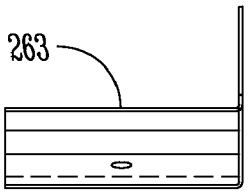

FIGS. 18A-C are alternative embodiment of the opposite end reflective visor insert in FIGS. 16A-C.

Figure 19A:
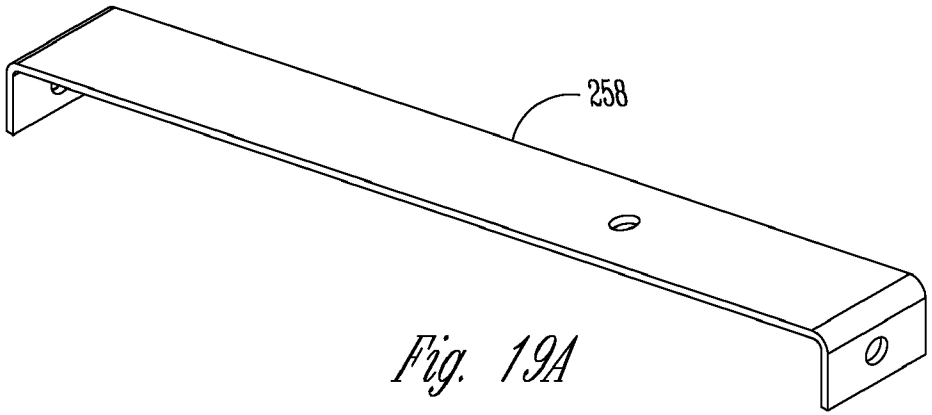
Figure 19B:
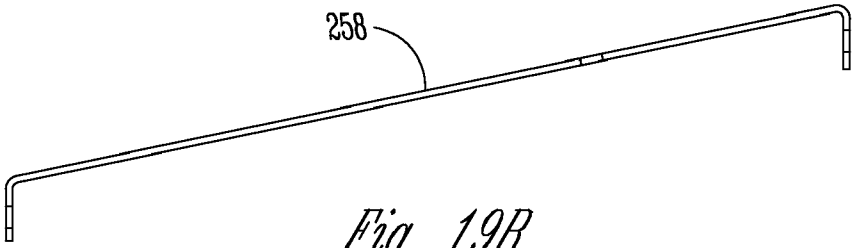
Figure 19C:
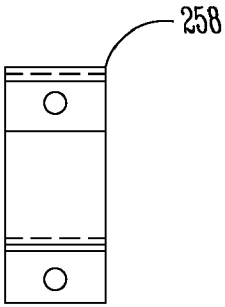

FIGS. 19A-C are views of a visor insert support for visor inserts of FIGS. 15A-16C.

Figure 20A:
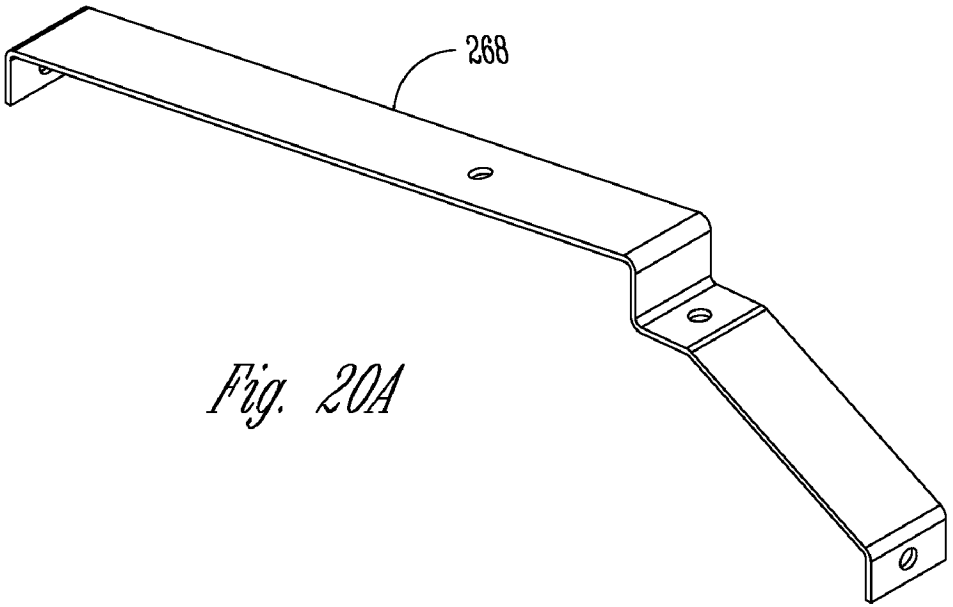
Figure 20B:
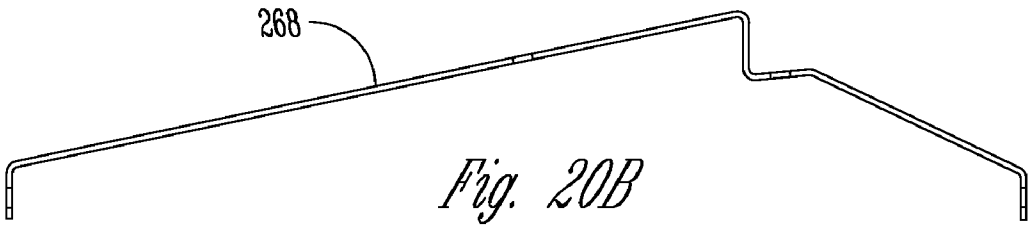
Figure 20C:
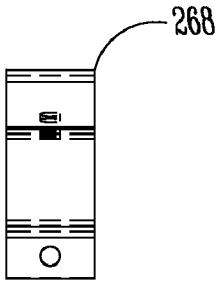
Figure 21C:
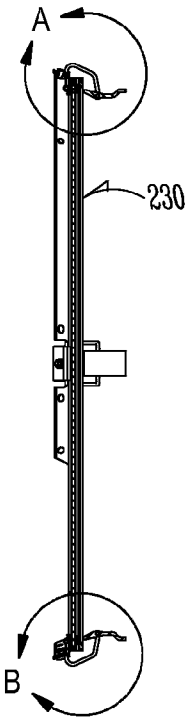
Figure 21B:
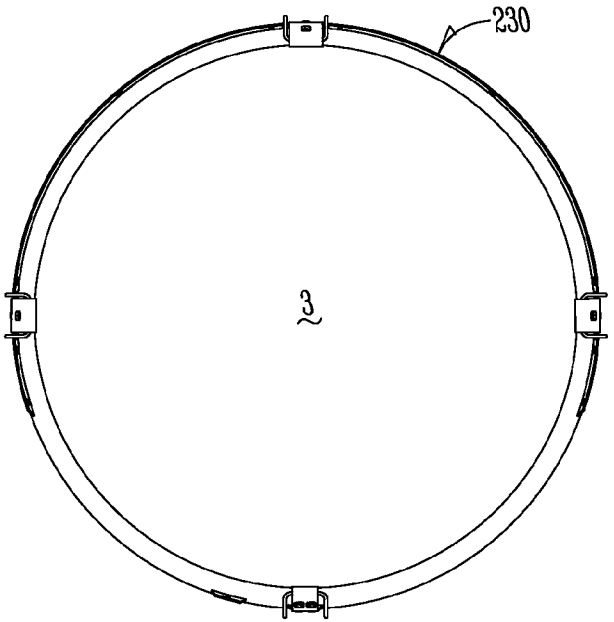
Figure 21E:
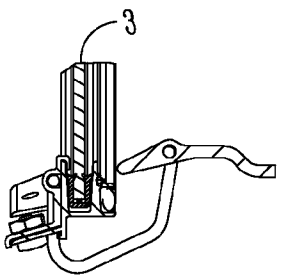
Figure 21A:
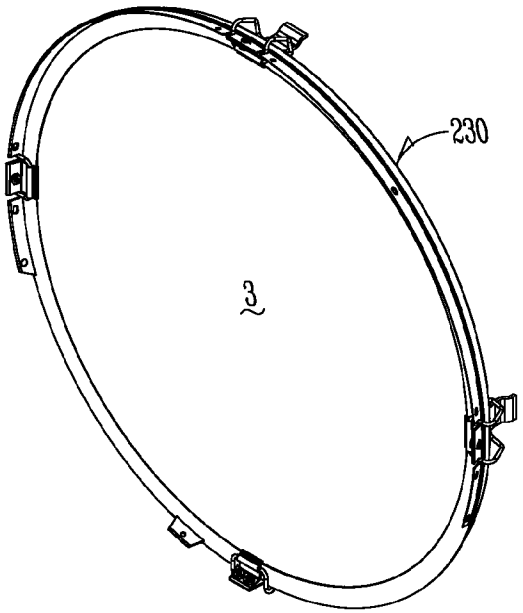
Figure 21D:
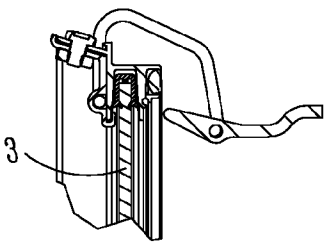

FIGS. 20A-C are views of a visor insert support useable with the reflective inserts of FIGS. 17A-18C.

FIGS. 21A-E illustrates a lens rim used with the embodiment of the preceding figures.

IV. DETAILED DESCRIPTION OF EXEMPLARY EMBODIMENTS

Figure 1C:
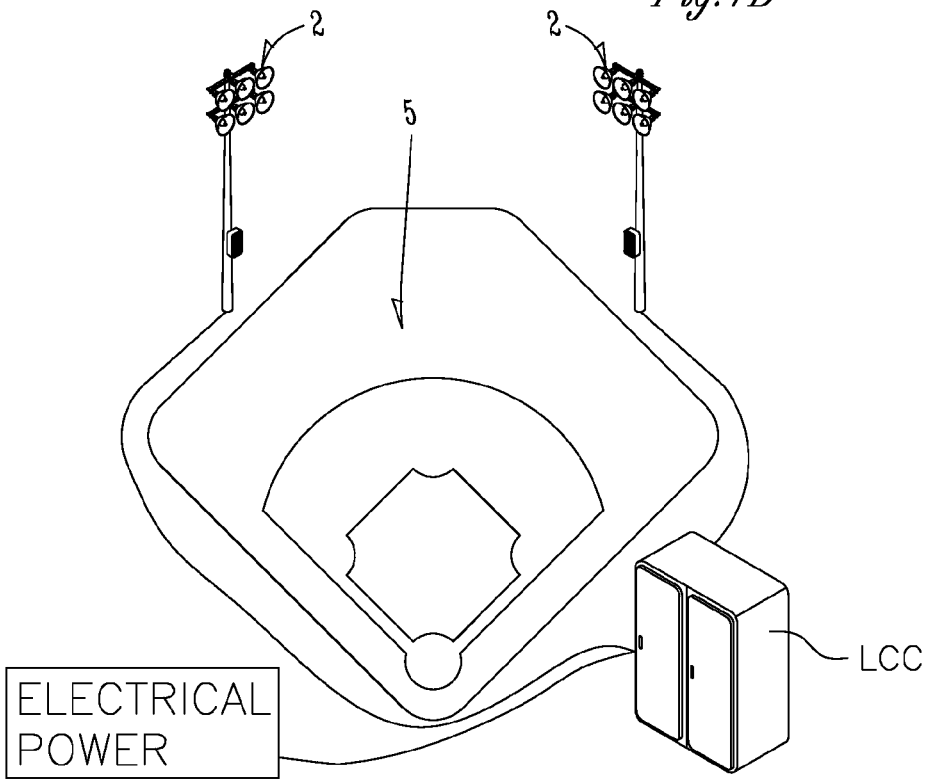
Figure 1D:
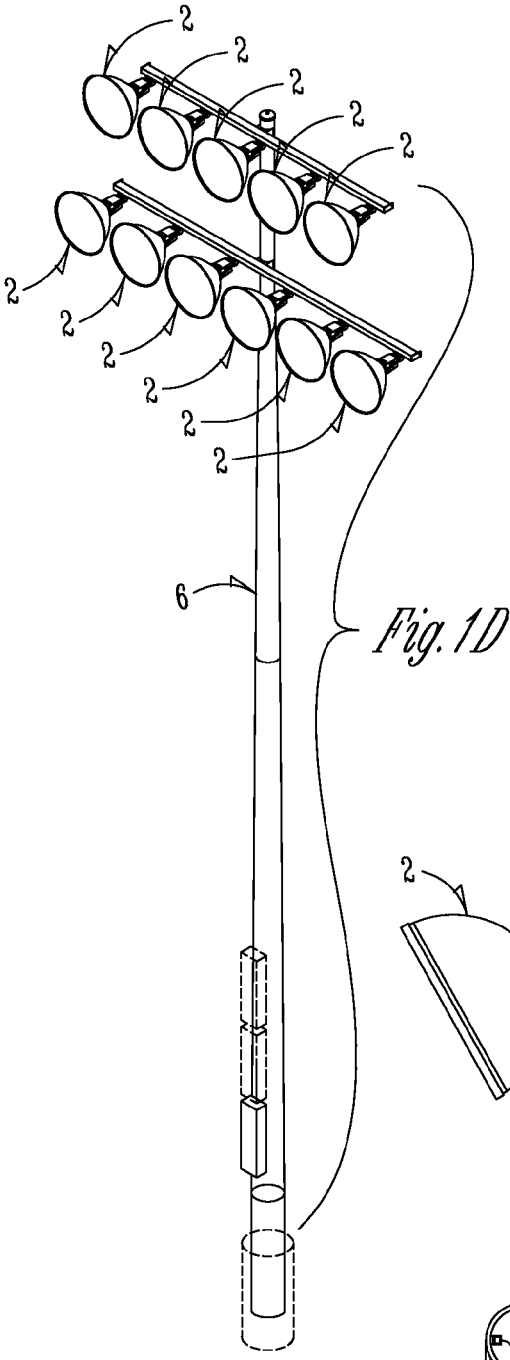
Figure 1C:
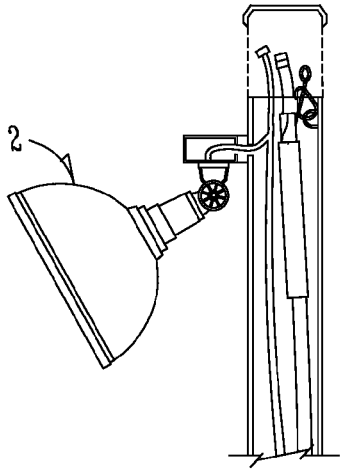
Figure 1E:
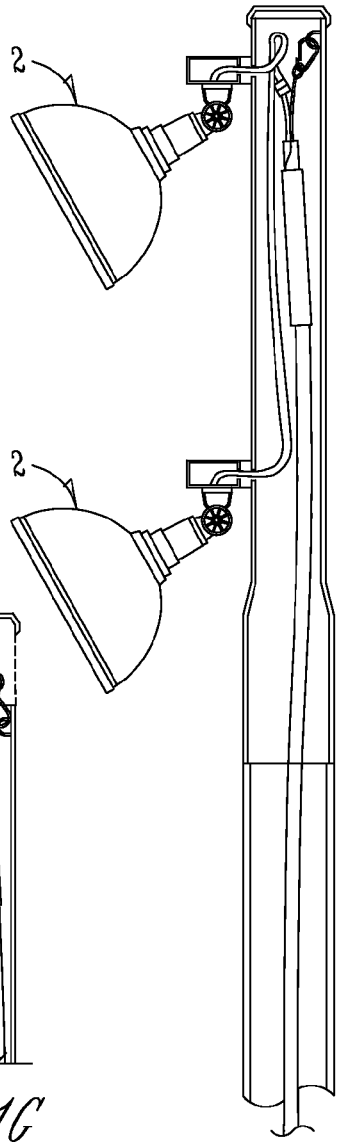
Figure 1F:
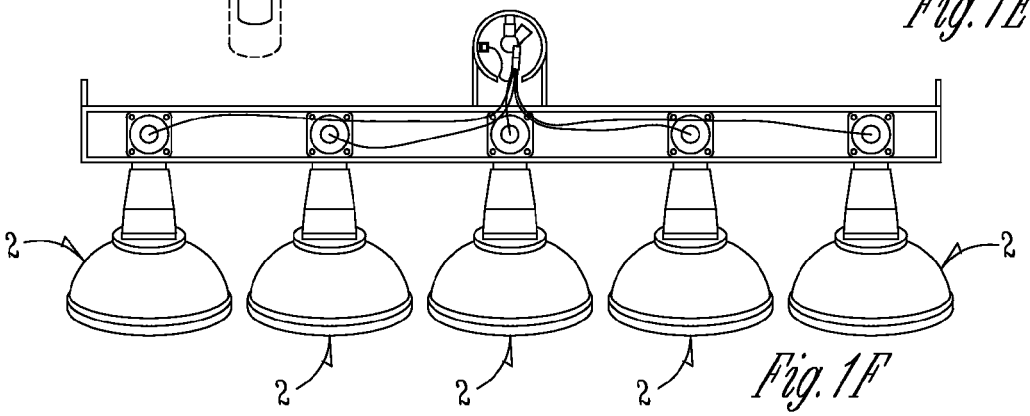

An embodiment of a light fixture will be described in the context of sports lighting, sports lighting fixtures, and sports lighting systems for the illumination of athletic fields 5 such as shown in FIGS. 1A and 1C. In this context, the athletic field is therefore the target area or space.

A. Exemplary Apparatus

1. Lighting Fixture 10 Generally

FIG. 3 shows the basic components of sports lighting fixture 10 in exploded form using a lamp 20 such as is illustrated in FIGS. 2A and B. FIGS. 4A-5B show it in two possible assembled perspective forms. Fixture 10 has some similar general components to state-of-the-art sports lighting fixtures, but introduces some different structural components and concepts.

Reflector frame 30 (cast aluminum type 413) bolts to lamp cone 40. The frame 230 (FIG. 21A-E) for glass lens 3 is removably latched to the front of reflector frame 30. Visor 70 is mountable to the lens frame and extends from the upper front of reflector frame 30 when in place. It includes high reflectivity strips on its interior 72.

As indicated by comparing FIGS. 4A and B with FIGS. 5A and B, visor 70 can take different shapes and forms. A first style of visor 70A (FIGS. 4A and B) is shorter and does not extend forwardly and downwardly as much as second visor style 70B (FIGS. 5A and B). Both have an identical base section (reference number 240, FIGS. 12A-H) that extends initially at a less converging angle from reflector frame 30. A distal extension section connects to the base section and angles back inwardly toward the central axis of reflector frame 30. The shorter visor 70A uses a shorter extension section (FIG. 13) than the longer visor 70B (see extension of FIG. 14A-C). Visor 70B is useful, for example, when fixture 10 is aimed at angles closer to horizontal. It would block and redirect more light that would otherwise go off the target area, as compared to visor 70A.

2. Visor 70

As indicated at FIG. 3, a visor 70 is attachable to fixture 10. High total reflectivity material is mounted on its inner or downward-facing side 72. Essentially the exterior of visor 70 is a protective cover over the high reflectivity material it supports. FIGS. 4A-5B illustrate two general forms visor 70 can take.

Either form of visor 70 actually is larger in size than many existing visors, and increases the overall size of fixture 10. However, their shape and configuration has been designed to actually decrease wind load by on the order of 40% over conventional fixtures. The length, shape, and edges of visors 70 are designed to improve the EPA of the whole fixture 10. They are cost effective with excellent reflection efficiency.

As can be seen in FIGS. 7A-D and 8A and B, a plurality of side-by-side, high reflectivity or reflectance reflector inserts (e.g., reflective inserts 252 and 253 of FIGS. 15A-16C) are riveted or otherwise secured to the inside of base reflector 240 and attached reflector 250; for the long visor combination reflective inserts 262 and 263 of FIGS. 17A-18C could be used. Alternatively, upper and lower rails 254 can be attached to proximal and distal positions on the inside of visor combination 240/250, and the reflective visors installed and then riveted or bolted into place (see 256). One or more radial support brackets 258 (see FIG. 19A-C), can be connected back to front of visor combination 240/250 to provide more rigidity for upper and lower visor reflective insert rails 254; for the long visor combination bracket 268 (see FIGS. 20A-C) could be used. Examples of high reflectivity inserts and materials are discussed in U.S. Pat. No. 6,036,338.

The shape of visor 70 is designed to achieve several functions. First, it supports the highly reflective inserts in a manner that controls spill and glare light. Second, it supports the reflective inserts in a manner which minimizes light loss, and can increase light to the target. Third, its shape minimizes the projected area of the visor and the fixture generally to produce a low coefficient of drag. Fourth, it accomplishes these functions in a relatively low cost but efficient way.

Even though the overall size of fixture 10 is larger than some conventional similar fixtures, the wind drag is reduced on the order of 40% or more. Spill and glare can be controlled with a visor 70, but also with other features disclosed herein, if used (e.g. lower initial output intensity, side shift, reflecting surfaces that highly control direction of light). This can allow cheaper poles to be utilized, which can significantly reduce overall capital cost of a lighting system. Less wind drag means the strength of the pole that elevates the fixtures can be less.

Visor 70 can be used even if glare and spill control is not an issue because of improved EPA of the fixture, which can reduce cost of poles. It has excellent efficiency and is relatively low cost. This is especially beneficial for outdoors sports lighting.

3. Visor Options

Optionally a prismatic material could be used in the visor opening for different lighting effects. An angled stepped prismatic reflector inside reflector 70 could also be used. Black paint could be used on the opposite sides of the visor reflecting surface for extreme glare and spill light control.

The visor, or the whole reflector frame/visor combination could be painted, ornamented, or otherwise configured in the colors of a team or school. Because the reflector frame and visor exteriors are cast, and do not contain the reflecting surface, painting is a more viable option.

It will be appreciated that the invention can take many forms and embodiments. Variations obvious to those skilled in the art will be included within the invention. The scope of the invention is defined solely by the claims and not by the specific examples herein.

For example, the method of attaching the reflective strips or other high reflectance surface to the underside of visor 70 can vary, as can the way it is supported (e.g., by a transition clip 264). FIGS. 16A-C and 18A-C illustrate reflective inserts that can be mounted at opposite sides of reflector 70. They have a shape to match the sides of visor 70.

Use of inserts allows for a relatively easy way to add a precise, high reflectivity surface. Change in shape of inserts can alter the way light is controlled so the designer can select them according to need or desire.

The figures illustrate one way of building a visor 70. A sheet aluminum base (FIG. 3) reflector is attached to a lens rim (FIG. 21A-E). A framework of aluminum or metal pieces is built (FIGS. 9A-E). Reflective insert strips and pieces are mounted to that framework (FIGS. 10A-E). The framework with attached reflective inserts is attached to the base reflector (FIGS. 11A-E). A visor extension, either a short aluminum sheet piece (FIG. 13) or long piece (FIGS. 14A-C) is then attached to the sub-assembly of FIGS. 11A-E.

What is claimed is:

1. An high intensity lighting fixture for increasing useable light to a target area without an increase in energy use comprising:

a. a reflector frame comprising a bowl-shaped outer surface generally defining a surface of revolution around an axis, an inner surface including mounting structure to which is mounted a reflector frame reflecting surface, and a primary opening through which the axis extends with a perimeter over which a glass lens is mountable to enclose an interior space adapted to substantially surround a light source to produce a controlled, concentrated light beam to issue through the lens generally in the direction of the axis;

b. a visor mounted to and extending outwardly from the top at least a substantial part of the perimeter of the primary opening of the reflector frame outside the interior space and lens generally in the direction of the axis, the visor having an outer side and an inner side;

c. a very high total reflectance visor reflecting surface removably mountable to the inner side of the visor adapted to reflect and redirect incident light from a portion of light beam issued from the interior space of the reflector frame generally downward when the fixture is in operating position relative a target area.

2. The lighting fixture of claim 1 wherein the visor inner side is adapted to support the high total reflectance reflecting surface extending outward from generally in the direction of the axis of the reflector frame.

3. The lighting fixture of claim 1 wherein the visor reflecting surface extends forwardly of and substantially above the axis when the fixture is in operating position.

4. The lighting fixture of claim 1 wherein the visor reflecting surface extends about or greater than 180° around the axis.

5. The lighting fixture of claim 1 wherein the visor reflecting surface is of a different shape than the reflector frame reflecting surface.

6. The lighting fixture of claim 1 wherein the visor reflecting surface redirects incident light generally downward to the target area when the fixture is in operating position.

7. The lighting fixture of claim 1 wherein the outer side of the visor comprises an exterior which, in combination with the reflector frame, presents a relatively improved effective projected area (EPA) and aerodynamic characteristics compared to conventional spun aluminum reflector fixtures.

8. A method of high intensity lighting to a target area for increase usable light without an increase in energy use, the lighting being supplied by one or more fixtures including a light source substantially surrounded by a primary reflecting surface supported and enclosed by a reflector frame having a lens over an opening issuing a light beam from a light output side of the fixture in a light beam direction, comprising:

a. extending a structure externally of the lens, enclosed light source, and primary reflecting surface generally in the light beam direction and partially into the light beam;

b. utilizing a removable very high total reflectance reflecting surface on the extension;

c. so that incident light from the light beam on the very high total reflectance reflecting surface of the extended structure can be redirected to the target to place more usable light at the target.

9. The method of claim 8 further comprising selecting between types, size, and reflecting characteristics of the very high total reflectance reflecting surface.

10. The method of claim 8 wherein the extended structure is configured to minimize wind drag and/or have a reduced effective projected area when mounted on the fixture.

11. A high intensity lighting fixture for increasing useable light to a target area without an increase in energy use comprising:

a. a lamp;

b. a reflector frame mountable to the lamp and comprising a bowl-shaped outer surface, an inner surface having a reflector mounted thereto and generally surrounding an axis and a front opening through which issues a light beam;

c. a glass lens attached to the front of the reflector frame enclosing the lamp and reflector;

d. a visor mounted to and extending from the reflector frame outside the lens generally in the direction of the axis, the visor having proximal and distal surfaces relative the axis;

e. a reflective insert attached to the proximal surface of the visor, the reflective insert having a very high total reflecting surface of 95% reflectivity;

f. whereby the lighting fixture produces a light beam, controls spill and glare light, minimizes light loss, increases light to the target area, and reduces wind drag.

12. A method for utilizing a high intensity lighting fixture for increasing useable light to a target area without an increase in energy, comprising:

a. mounting a high intensity lamp in a reflector frame comprising a bowl-shaped outer surface, a reflector mounted on an inner surface, an open front, and a glass lens mounted over the open front, the lamp and reflector issuing a light beam through the lens;

b. attaching a visor having inner and outer surfaces to the reflector frame adjacent the glass lens and extending forwardly of the glass lens generally in the direction of the light beam;

c. fastening a reflective insert to the inner surface of the visor, the reflective insert having a very high total reflecting surface of on the order of 95% reflectivity or more and positioned to reflect a portion of light from the light beam to the target area;

d. applying the lighting fixture to a target area whereby the lighting fixture projects light to the target area, controls spill and glare light, minimizes light loss and increases light to the target area, and reduces wind drag.

* * * * *

UNITED STATES PATENT AND TRADEMARK OFFICE

CERTIFICATE OF CORRECTION

PATENT NO. : 7,789,540 B2
APPLICATION NO. : 11/334007
DATED : September 7, 2010
INVENTOR(S) : Myron K. Gordin It is certified that error appears in the above-identified patent and that said Letters Patent is hereby corrected as shown below:

Col. 3, Line 47:
DELETE after and "-B"
ADD after and -- B --

Signed and Sealed this

Seventh Day of December, 2010

David J. Kappos

David J. Kappos
*Director of the United States Patent and Trademark Office*